US009643448B2

(12) United States Patent
Ryan

(10) Patent No.: US 9,643,448 B2
(45) Date of Patent: May 9, 2017

(54) MOISTENING SYSTEM FOR ENVELOPES THAT REDUCES CLOGGING CAUSED BY CONTAMINANTS

(75) Inventor: Michael S Ryan, Newtown, CT (US)

(73) Assignee: Pitney Bowes Inc., Stamford, CT (US)

( * ) Notice: Subject to any disclaimer, the term of this patent is extended or adjusted under 35 U.S.C. 154(b) by 1250 days.

(21) Appl. No.: 13/242,063

(22) Filed: Sep. 23, 2011

(65) Prior Publication Data

US 2013/0074768 A1 Mar. 28, 2013

(51) Int. Cl.

| | |
|---|---|
| ***B05C 11/105*** | (2006.01) |
| ***B05C 1/02*** | (2006.01) |
| ***B05C 5/00*** | (2006.01) |
| ***B43M 5/04*** | (2006.01) |

(52) U.S. Cl.

CPC ..... *B43M 5/042* (2013.01); *B05C 1/025* (2013.01); *B05C 5/004* (2013.01); *B05C 11/105* (2013.01)

(58) Field of Classification Search

None

See application file for complete search history.

(56) References Cited

U.S. PATENT DOCUMENTS

| | | | | |
|---|---|---|---|---|
| 5,209,806 | A * | 5/1993 | Hibberd | 156/441.5 |
| 5,641,349 | A * | 6/1997 | Koubek et al. | 106/206.1 |
| 6,554,956 | B1 * | 4/2003 | Dolan et al. | 156/441.5 |
| 2002/0170681 | A1 * | 11/2002 | Saurer et al. | 156/441.5 |
| 2004/0082654 | A1 * | 4/2004 | Pesce et al. | 514/547 |
| 2006/0124246 | A1 | 6/2006 | Spisinski et al. | |
| 2007/0142259 | A1 | 6/2007 | Bernard et al. | |
| 2008/0139661 | A1 * | 6/2008 | Bernard et al. | 514/643 |

* cited by examiner

*Primary Examiner* — Karl V. Kurple

*Assistant Examiner* — Jethro M Pence

(74) *Attorney, Agent, or Firm* — Brian A. Lemm; Charles R. Malandra, Jr.; Steven J. Shapiro

(57) ABSTRACT

A moistening system that significantly reduces the problems caused by contaminants in the moistening fluid is provided. The catch basin of a moistening system is provided with a filter that reduces the amount of contaminants contained in the recycled moistening fluid. Additionally, the moistening fluid is buffered with an acid that acts to dissolve the paper filler and other soluble debris that may be introduced into the moistening fluid, thereby significantly decreasing any blinding of components of the moistening system that would otherwise reduce the flow rate of the moistening fluid through the system. These ensure that sufficient moistening fluid is applied to the envelope flaps, which results in consistent and complete sealing of the envelope flaps.

13 Claims, 4 Drawing Sheets

MOISTENING SYSTEM FOR ENVELOPES THAT REDUCES CLOGGING CAUSED BY CONTAMINANTS

FIELD OF THE INVENTION

The invention disclosed herein relates generally to moistening systems such as those used in mailing systems to seal envelope flaps, and more particularly to a moistening system that prevents clogging of components thereof.

BACKGROUND OF THE INVENTION

Mailing systems, such as, for example, a mailing machine, often include different modules that automate the processes of producing mail pieces. The typical mailing machine includes a variety of different modules or subsystems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a stripping/moistening module, i.e., stripping open the flap of an envelope, wetting and sealing the glued flap of an envelope, a weighing module, and a metering/printing module, i.e., applying evidence of postage to the mail piece. The exact configuration of the mailing machine is, of course, particular to the needs of the user. Other types of mailing systems, such as, for example, inserters, feed material from one or more trays to be inserted into awaiting envelopes whose flaps have been opened and then sealed when the contents have been inserted.

Typically, a stripping device includes a structure for deflecting a flap of a moving envelope away from the envelope's body to enable the moistening and sealing process to occur. The deflecting structure typically includes a stripper blade that becomes inserted between the flap of the envelope and the body of the envelope as the envelope traverses the transport deck of the mailing machine. Once the flap has been stripped, a moistening device moistens the glue line on the envelope flap in preparation for sealing the envelope. Typically, a moistening fluid is deposited onto the envelope flap to activate the glue. The flap is then closed and sealed, such as, for example, by passing the closed envelope through a nip of a sealer roller to compress the envelope and flap together, and the envelope passed to the next module for continued processing.

In typical moistening applications, it is desirable to maintain a catch basin beneath the moistening device to collect moistening fluid that is discharged by the moistening device but not carried away by the envelope. Preferably, this moistening fluid is recycled and stays within the moistening device for subsequent usage. Unfortunately, this fluid becomes contaminated with different materials derived from the paper and adhesive. Contaminants include, for example, envelope adhesive and paper dust, comprising paper fibers and filler used to make paper envelopes, which are released by the friction associated with the envelope contacting different parts of the mailing system, such as the stripper/moistening module. Such contaminants negatively impact the operation of the moistening device such as, for example, clogging of components that supply the moistening fluid to the different parts of the moistening device. These situations can result in insufficient moistening fluid being applied to the envelope flaps, which results in inconsistent sealing of the envelopes.

SUMMARY OF THE INVENTION

The present invention alleviates the problems associated with the prior art and provides a moistening system that significantly reduces the problems caused by contaminants in the moistening fluid.

In accordance with the present invention, the catch basin of a moistening system is provided with a filter that reduces the amount of contaminants contained in the recycled moistening fluid. Additionally, the moistening fluid is buffered with an acid that acts to dissolve the paper filler and other soluble debris that may be introduced into the moistening fluid, thereby significantly decreasing any blinding of the filter or other components that would otherwise reduce the flow rate of the moistening fluid through the system. These ensure that sufficient moistening fluid is applied to the envelope flaps, which results in consistent and complete sealing of the envelope flaps.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
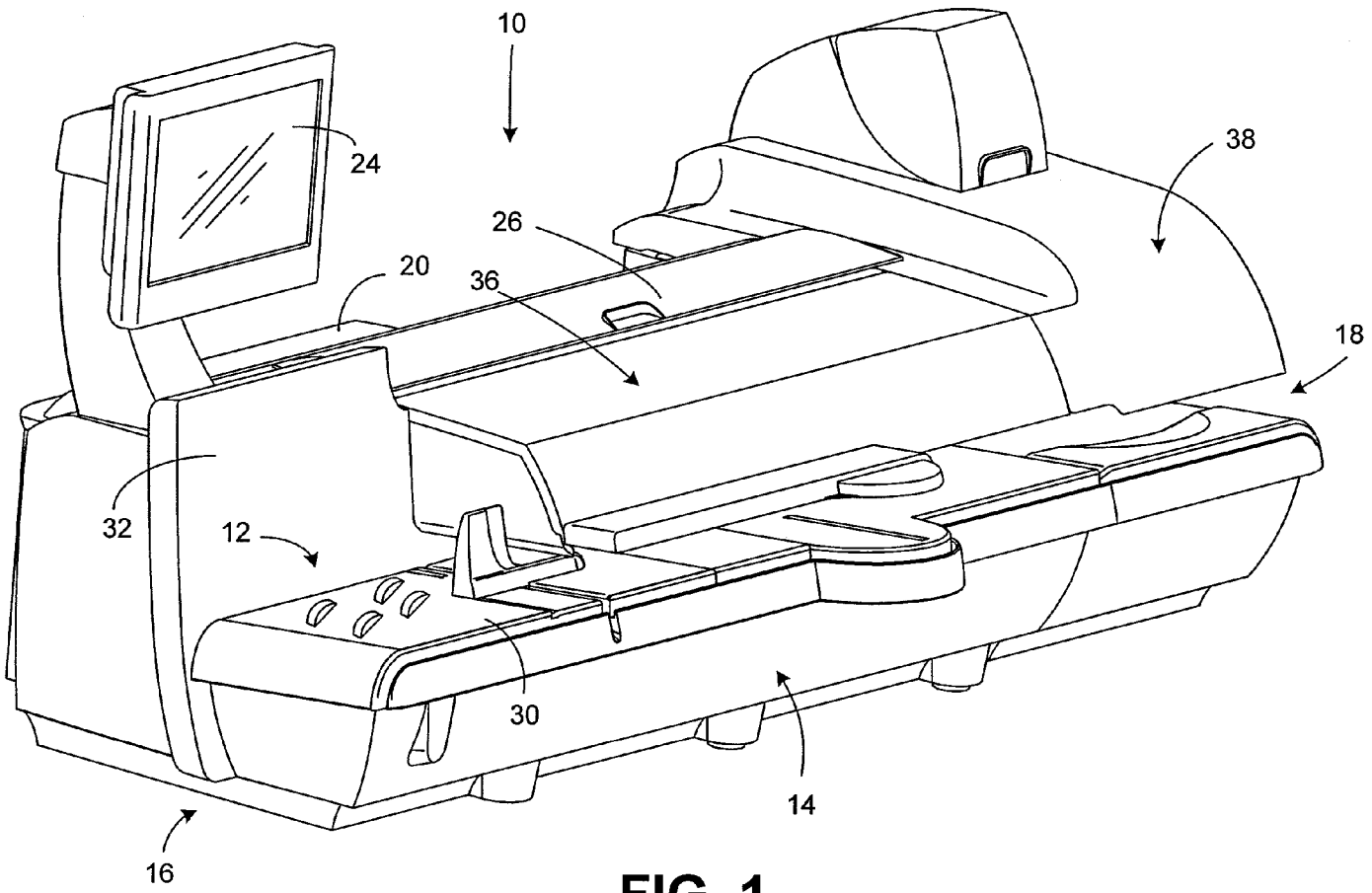
FIG. 1 illustrates a mailing machine in which the moistening system of the present invention can be utilized.

In describing the present invention, reference is made to the drawings, wherein there is seen in FIG. 1 a mailing machine 10 that includes a moistening system according to the present invention. Mailing machine 10 comprises a base unit, designated generally by the reference numeral 14, the base unit 14 having a mail piece input end, designated generally by the reference numeral 16, and a mail piece output end, designated generally by the reference numeral 18. A control unit 20 is mounted on the base unit 14, and includes one or more input/output devices, such as, for example, a touch-screen display device 24. One or more cover members 26 are pivotally mounted on the base 14 so as to move from the closed position shown in FIG. 1 to an open position (not shown) to expose various operating components and parts for service and/or repair as needed.

The base unit 14 further includes a horizontal feed deck 30 which extends substantially from the input end 16 to the output end 18. A plurality of nudger rollers 12 are suitably mounted under the feed deck 30 and project upwardly through openings in the feed deck so that the periphery of the rollers 12 is slightly above the upper surface of the feed deck 30 and can exert a forward feeding force on a succession of mail pieces placed in the input end 16. A registration wall 32 defines a mail piece registration surface substantially perpendicular to the feed deck 30 that extends substantially from the input end 16 to the output end 18. Mail pieces placed in the input end 16 are fed by the nudger rollers 12 along the feed deck 30, with the top edge of the mail piece being registered against the wall 32. The mail pieces may be passed through one or more modules, such as, for example, a singulator module and a moistening module that includes a moistening system according to the present invention as described below. Each of these modules is located generally in the area indicated by reference numeral 36. The mail pieces are then passed to a metering/printing module located generally in the area indicated by reference numeral 38.

Figure 2:
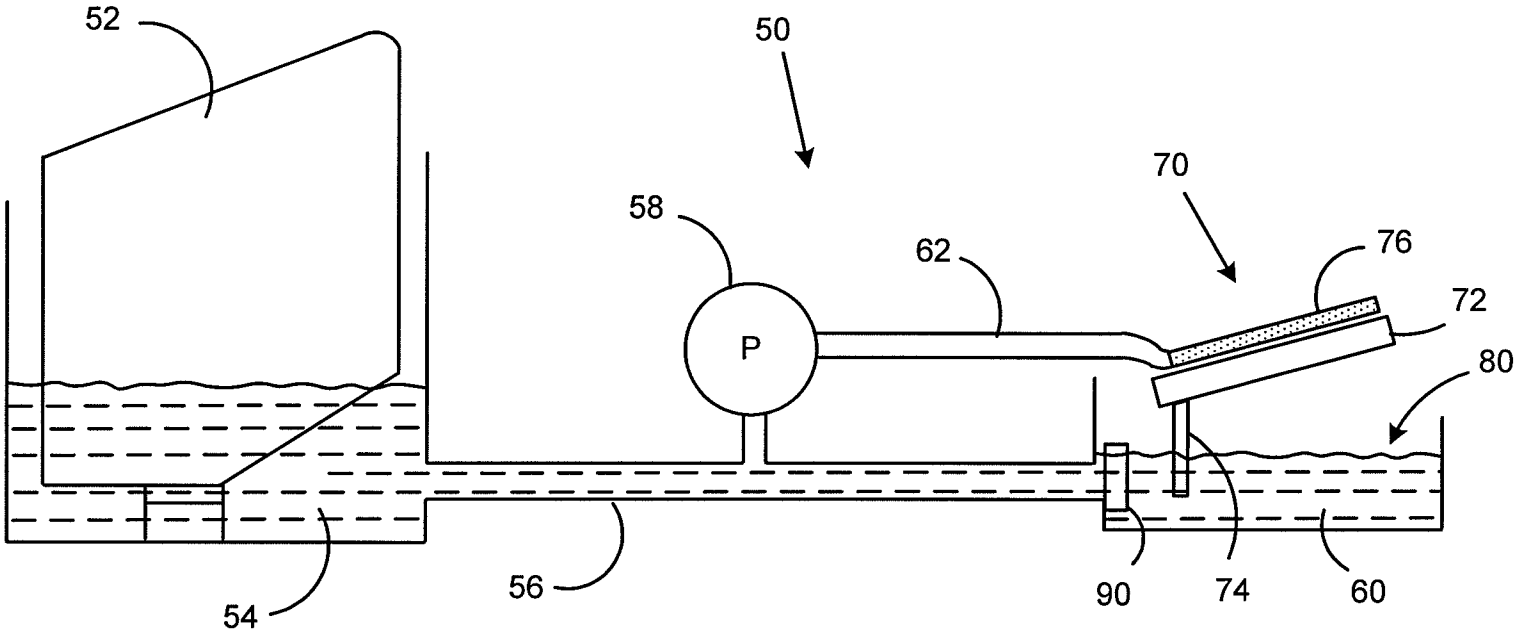
FIG. 2 illustrates a portion of a moistening system according to the present invention.

FIG. 2 illustrates in block diagram form a moistening system 50 according to an embodiment of the present invention. System 50 includes a replaceable bottle 52 that can be inserted into a reservoir 54. Reservoir 54 is preferably mounted in, for example, the base unit of the mailing machine 10. Under normal operation, moistening fluid contained in the bottle 52 empties into the reservoir 54. The reservoir 54 supplies the moistening fluid via tubing 56 to a pump 58 and a well 60. Pump 58, via tubing 62, supplies the moistening fluid to a moistening device 70. Moistening device 70 includes a wetting element 72, typically formed from a contact media such as foam or felt, which is secured to the trailing edge of a stripping blade (not shown). The wetting element 72 is supplied with moistening fluid, through physical contact with a wick 74, a portion of which is located in the moistening fluid 80 contained in the well 60, and capillary action of the moistening fluid. The wetting element is also supplied with moistening fluid via the pump 58 which supplies the moistening fluid to a discharge device 76 that includes a series of openings or nozzles to distribute moistening fluid onto the wetting element 72.

Figure 3:
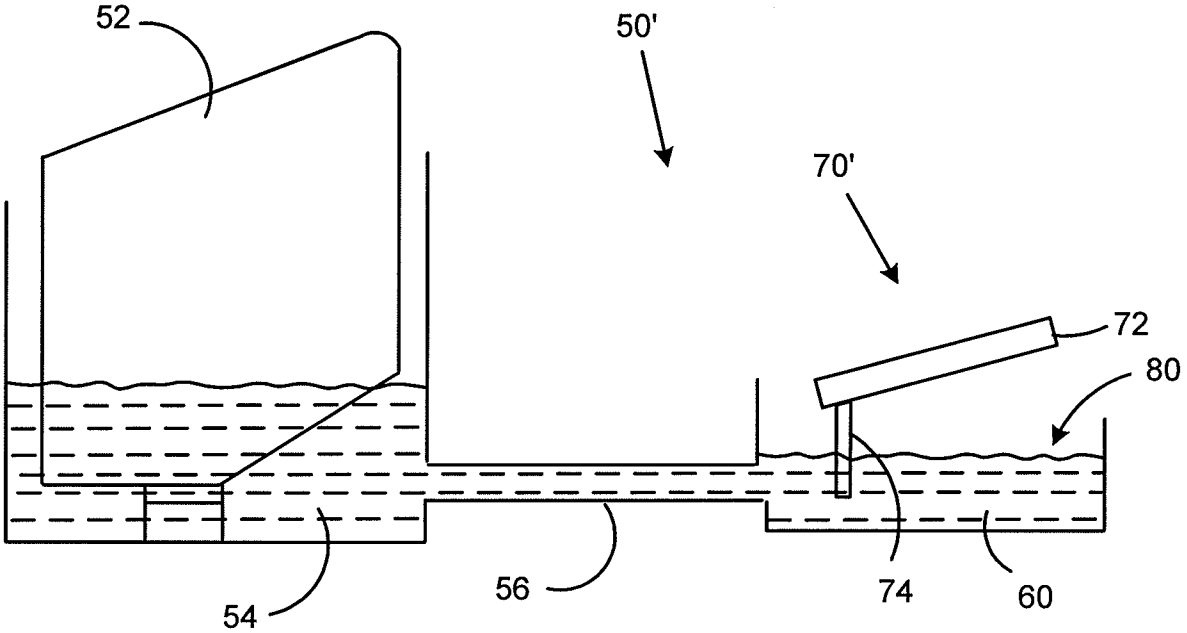
FIG. 3 illustrates a portion of another moistening system according to the present invention.

FIG. 3 illustrates in block diagram form a second moistening system 50' according to an embodiment of the present invention. System 50' is similar to system 50 in that it includes a replaceable bottle 52 that can be inserted into a reservoir 54. Reservoir 54 is preferably mounted in, for example, the base unit of the mailing machine 10. Under normal operation, moistening fluid contained in the bottle 52 empties into the reservoir 54. The reservoir 54 supplies the moistening fluid via tubing 56 to a well 60. Moistening device 70' includes a wetting element 72, typically formed from a contact media such as foam or felt, which is secured to the trailing edge of a stripping blade (not shown). The wetting element 72 is supplied with moistening fluid, through physical contact with a wick 74, a portion of which is located in the moistening fluid 80 contained in the well 60, and capillary action of the moistening fluid. It should be noted that the wick 74 and wetting element 80 need not be separate items, and instead the wick 74 can be integrated with the wetting element 72, or a portion of the wetting element 80 can act as a wick and be located in the moistening fluid 80 contained in the well 60.

As an envelope passes through the moistening device 70 or 70', the inside of the envelope flap, where the glue line for sealing the flap is located, contacts the wetting element 72, such that the wetting element 72 transfers moistening fluid to the flap to activate the glue. The moistening device 70 and 70' illustrated in FIGS. 2 and 3 are contact moistening systems, in which moistening fluid is deposited onto the glue line on a flap of an envelope by contacting the glue line with a wetting element. It should be understood, however, that moistening device 70 of FIG. 2 could also be a non-contact moistening device, in which moistening fluid is sprayed directly onto the envelope flap with a nozzle and mechanical pump system. The mechanical pump is supplied with moistening fluid from a reservoir and sprays the fluid through the nozzles and onto the envelope flap.

Regardless of whether the moistening device 70 is a contact or non-contact, the well 60 beneath both types of moistening devices 70 and 70' collects moistening fluid that is discharged by the moistening device 70, 70' but not carried away by the envelope. This moistening fluid in the system 50 is recycled and stays within the moistening system 50 for subsequent usage via tube 56, while the moistening fluid in the system 50' is recycled by again coming in contact with the wick 74. Unfortunately, this recycled fluid becomes contaminated with different materials derived from the paper and adhesive. Contaminants include, for example, envelope adhesive and paper dust comprising paper fibers and filler used to make paper envelopes, which are released by the friction associated with the envelope contacting different parts of the mailing system, such as the stripper/moistening module. Such contaminants negatively impact the operation of the moistening system 50 such as, for example, by clogging of the pump 58, tubing 62, discharge device 76, or nozzles in a non-contact system. These situations can result in insufficient moistening fluid being applied to the envelope flaps, which results in inconsistent sealing of the envelopes. To prevent such clogging in the system 50, a filter pad 90 is provided at the junction between the well 60 and tubing 56. Filter pad 90 is preferably a rectangular cuboid comprised of woven polyester fibers. The fiber orientation is primarily homogenous, which allows the moistening fluid to freely pass through in multiple directions, but will catch contaminants. Thus, while the moistening fluid will freely pass through the filter pad 90, a majority of any contaminants contained within the moistening fluid in the well 60 will be trapped by the filter pad 90, thereby keeping the other moistening system components, e.g., pump 58, tubing 62, discharge device 76, free from contaminants which can cause clogging.

Utilizing the filter pad 90 can resolve many of the problems associated with the clogging of the moistening device 70. However, a frequent cause of moistener system failure is the collection of contaminants on the filter pad such that the moistening fluid can no longer pass through the filter pad 90 (referred to as blinding of the filter pad). In addition, although the filter pad 90 can remove a large portion of the contaminants, any amounts that do pass through the filter pad 90 can eventually lead to blinding of the wetting element 72. For system 50', the collection of contaminants on the wick 74 and wetting element eventually lead to blinding of the wick 74 and wetting element 72. It was unexpectedly found that a weak acid-buffered moistening solution maintained flow rate through the filter, thus greatly increasing the filter life. Additionally, blinding of the wick 74 and wetting element 72 was significantly reduced. This was unexpected because paper fibers are not soluble in weak acids. The present inventors have surmised that the majority of the contamination is caused by carbonate paper fillers, which are soluble in weakly acidic solutions. To prevent such blinding, the moistening fluid is preferably buffered to an acidic pH using an appropriate acid buffer. Typical moistening fluids consist of distilled water, a biocide (to prevent biological growth) and a dye. Other ingredients may also include alcohol detergent and a fragrance. In accordance with the present invention, the pH of the moistening fluid is preferably buffered to approximately 3.0. The acid buffer could be, for example, citric acid, citric acid/sodium citrate, potassium hydrogen phthalate/hydrochloric acid, acetic acid, acetic acid/sodium acetate, hydrochloric acid/sodium citrate, etc. The acid buffer works to dissolve the paper filler and other soluble debris that may be introduced into the moistening fluid. The general composition of two exemplary moistening fluids are provided in Table 1 below.

TABLE 1

| Moistening Solution Formulation With Acid Buffers Buffer Strength = 10 mM | | | |
|---|---|---|---|
| Citric Acid Buffered | | Acetic Acid Buffered | |
| Water | 97.7699776 | Water | 99.3859776 |
| Biocide | 0.0000064 | Biocide | 0.0000064 |
| Dye | 0.0000160 | Dye | 0.0000160 |
| Citric Acid | 1.8000000 | Acetic Acid | 0.5900000 |
| Sodium Citrate | 0.4300000 | Sodium Acetate | 0.0240000 |
| Total | 100.0 | | 100.0 |

Figure 4:
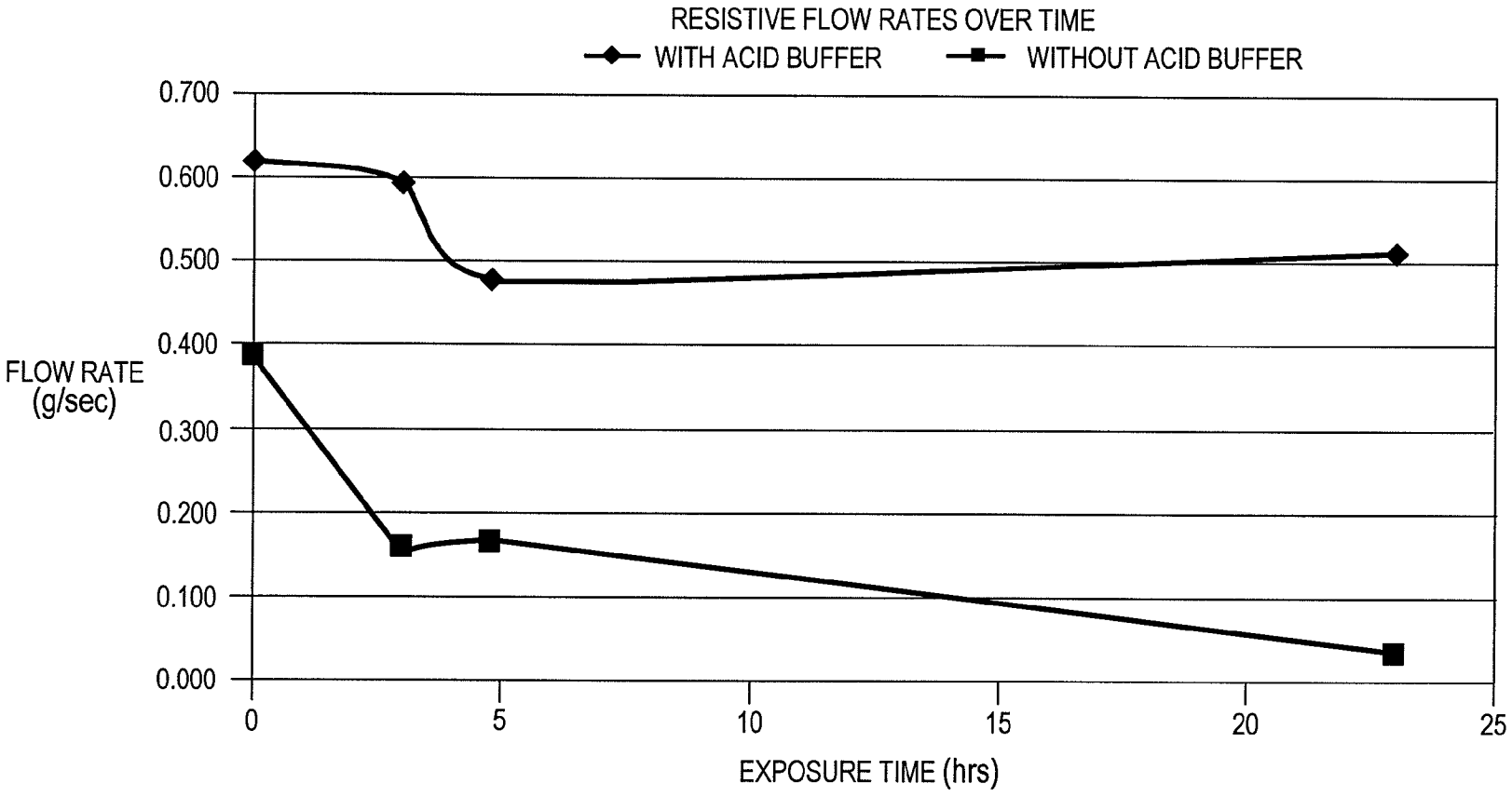
FIG. 4 is a graph illustrating the resistive flow rates of exemplary filters when tested with conventional moistening fluid and a moistening fluid according to the present invention.

FIG. 4 illustrates the resistive flow rates of exemplary filters when tested with conventional moistening fluid (no acid buffer added) and a moistening fluid according to the present invention (with acid buffer added). The test was performed as follows: (1) Two 1 L fluids of 0.5% and 0.464% adhesive and dust were made, one in conventional moistening fluid and the other in a moistening fluid buffered with 1.5% Citric acid. (2) Pads and pumps were set up for each fluid. (3) Baseline cup and resistive tests were taken before the start. (4) Each set was set-up to re-circulate the fluid from the beaker to the pad. (5) Pumps were run until there was a significant drop in resistive test. (6) Resistive measurements were taken periodically during exposure. (7) Final resistive and cup tests were taken for comparison. Table 2 illustrates the test results.

TABLE 2

| Flow rate (g/sec) | | |
|---|---|---|
| | Pad #1—Acid | Pad #2—No Acid |
| Baseline Average | | |
| Cup: | 0.786 | 0.699 |
| Resistive: | 0.621 | 0.386 |
| Post-Exposure Average | | |
| Cup: | 0.686 | 0.543 |
| Resistive: | 0.511 | 0.034 |
| Cup Performance Drop | −13% | −22% |
| Total Performance Drop | −18% | −91% |
| Resulting Drop due to Pad | −5% | −69% |

As can be seen from the graph in FIG. 4, the flow rate of the filter that was tested with the moistening fluid having the acid buffer dropped from 0.61 g/sec to approximately 0.51 g/sec. In comparison, the flow rate of the filter that was tested with a conventional moistening fluid (no acid buffer) dropped from approximately 0.39 g/sec to less than 0.05 g/sec. After factoring out pump performance fluctuations, the resulting drop in performance due to pad blinding is 69% for the moistening fluid without the acid buffer. In contrast, the moistening fluid with the acid buffer only experienced a drop of 5%. By comparing pre- and post-exposure resistive tests, the addition of acid in the moistening fluid indeed significantly improved performance of the filter.

While the present invention has been described with respect to a mailing machine, it should be understood that the present invention is not so limited and can be utilized with any device that has a moistening/sealing system, such as, for example, an inserter and the like. While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A moistening system for moistening an envelope flap for sealing of an envelope, the moistening system comprising:

a reservoir to hold moistening fluid;

a moistening device for applying the moistening fluid to a flap of the envelope passing through the moistening system;

a well located beneath the moistening device to collect moistening fluid discharged by the moistening device that is not carried away by the envelope, the well being coupled to the reservoir by a supply tube; and the moistening fluid including an acid buffer, such that the moistening fluid has an acidic pH value, to dissolve paper filler contained in the moistening fluid in the well, wherein dissolving of the paper filler reduces clogging of the moistening device that can be caused by the paper filler.

2. The moistening system of claim 1, wherein the moistening device is a contact moistening device.

3. The moistening system of claim 1, wherein the moistening device is a non-contact moistening device.

4. The moistening system of claim 1, wherein the moistening fluid has a pH value of approximately 3.0.

5. The moistening system of claim 1, wherein the acid buffer is a citric acid.

6. The moistening system of claim 1, wherein the acid buffer is a citric acid/sodium citrate buffer.

7. The moistening system of claim 1, wherein the acid buffer is a potassium hydrogen phthalate/hydrochloric acid buffer.

8. The moistening system of claim 1, wherein the acid buffer is an acetic acid buffer.

9. The moistening system of claim 1, wherein the acid buffer is an acetic acid/sodium acetate buffer.

10. The moistening system of claim 1, wherein the acid buffer is a hydrochloric acid/sodium citrate buffer.

11. The moistening system of claim 1, further comprising:

a pump device coupled to the reservoir by the supply tube, the pump device being coupled to the moistening device to provide moistening fluid to the moistening device.

12. The moistening device of claim 11, further comprising:

a filter to filter the collected moistening fluid that enters the supply tube from the well, wherein dissolving of the paper filler reduces clogging of the filter and moistening device that can be caused by the paper filler.

13. The moistening system of claim 1, further comprising:

a wick to provide moistening fluid from the well to the moistening device, wherein dissolving of the paper filler reduces clogging of the wick and moistening device that can be caused by the paper filler.

* * * * *